US012722821B2

(12) United States Patent
Schmid et al.

(10) Patent No.: US 12,722,821 B2
(45) Date of Patent: Sep. 1, 2026

(54) STRAPPING DEVICE AND METHOD FOR PRODUCING STRAPPED PACKAGES

(71) Applicant: Krones Aktiengesellschaft, Neutraubling (DE)

(72) Inventors: Sebastian Schmid, Rosenheim (DE); Thomas Stadler, Kolbermoor (DE); Herbert Spindler, Niedermoosen (DE)

(73) Assignee: Krones Aktiengesellschaft, Neutraubling (DE)

( * ) Notice: Subject to any disclaimer, the term of this patent is extended or adjusted under 35 U.S.C. 154(b) by 56 days.

(21) Appl. No.: 18/267,618

(22) PCT Filed: Dec. 14, 2021

(86) PCT No.: PCT/EP2021/085612

§ 371 (c)(1),
(2) Date: Jun. 15, 2023

(87) PCT Pub. No.: WO2022/152485

PCT Pub. Date: Jul. 21, 2022

(65) Prior Publication Data

US 2024/0051694 A1 Feb. 15, 2024

(30) Foreign Application Priority Data

Jan. 13, 2021 (DE) ..... 10 2021 100 541.8

(51) Int. Cl.
*B65B 13/32* (2006.01)
*B65B 13/16* (2006.01)
(Continued)

(52) U.S. Cl.
CPC ..... *B65B 13/325* (2013.01); *B65B 13/16* (2013.01); *B65B 21/245* (2013.01); *B65B 49/12* (2013.01)

(58) Field of Classification Search
CPC ..... B65B 13/325; B65B 13/16; B65B 21/245; B65B 49/12; B65B 13/185; B65B 13/30; B65B 13/32; B65B 27/04; B65B 49/00
See application file for complete search history.

(56) References Cited

U.S. PATENT DOCUMENTS 3,073,086 A * 1/1963 Thomas ..... B65B 27/04 53/399
3,194,281 A * 7/1965 Frey ..... B65B 13/305 100/29

(Continued)

FOREIGN PATENT DOCUMENTS

CN 217779523 U * 11/2022 ..... B65D 71/50
DE 102010001190 A1 7/2011

(Continued)

OTHER PUBLICATIONS

PCT Application: PCT/EP2021/085612 Filed Dec. 14, 2021—International Preliminary Report on Patentability dated Jul. 27, 2023.

(Continued)

*Primary Examiner* — Veronica Martin
*Assistant Examiner* — Mobeen Ahmed
(74) *Attorney, Agent, or Firm* — Simmons Perrine PLC

(57) ABSTRACT

The invention relates to a strapping device and a method for producing strapped packages, which combine at least two articles by at least one strap. The strapping device is paired with a device for providing two or more grouped articles. and the strapping device comprises a handling device (10) with two pivoting arms (11, 12) which can be adjusted relative to each other and each of which is equipped with clamping devices (14, 15) for fixing the belt ends (27) of a strapping belt (26) or a strapping blank (28) in a clamped manner. The pivoting arms (11, 12) can surround the grouped articles for the purpose of strapping same, thereby (Continued)

pivoting the first pivoting arm (11) and the second pivoting arm (12). The strapping device additionally comprises a fixing device for connecting the two belt ends (27) of the strapping belt (26) or the strapping blank (28).

9 Claims, 3 Drawing Sheets

(51) Int. Cl.
*B65B 21/24* (2006.01)
*B65B 49/12* (2006.01)

(56) References Cited

U.S. PATENT DOCUMENTS 3,291,163 A * 12/1966 Timmerbeil ..... B65B 13/305 140/93.2
3,404,505 A * 10/1968 Hohl ..... B65B 27/04 53/399
3,714,756 A * 2/1973 MacInnes ..... B65B 27/04 53/543
3,794,086 A * 2/1974 Hall ..... B21F 9/02 140/93.2
4,016,023 A * 4/1977 Takami ..... B65B 13/32 156/499
4,154,158 A * 5/1979 Leslie ..... B65B 13/30 100/32
4,169,343 A * 10/1979 McArdle ..... B65B 17/025 53/398
4,357,186 A * 11/1982 Calvert ..... B29C 65/08 156/218
4,527,379 A * 7/1985 Bartzick ..... B29C 65/2092 100/29
4,559,767 A * 12/1985 Takami ..... B65B 13/22 100/32
4,705,331 A * 11/1987 Britton ..... B63C 11/52 269/254 R
4,850,179 A * 7/1989 Takami ..... B65B 13/22 53/589
4,938,009 A * 7/1990 Takami ..... B65B 13/18 242/546
5,588,278 A * 12/1996 Wynn ..... B65B 13/022 53/399
5,615,538 A * 4/1997 Miyashita ..... B65B 13/22 53/589
5,715,873 A * 2/1998 Figiel ..... B65B 13/305 140/93.2
6,041,572 A * 3/2000 Gandini ..... B65D 63/1009 53/399
6,055,791 A 5/2000 Odum et al.
6,202,387 B1 * 3/2001 Brown ..... B65B 67/10 53/590
6,536,336 B1 * 3/2003 Jaenson ..... B65B 13/32 100/33 PB
6,772,798 B2 * 8/2004 Cheung ..... B65B 13/305 140/93.2
7,428,865 B1 * 9/2008 Kasel ..... B65B 27/10 53/529
7,716,900 B2 * 5/2010 Schmetzer ..... B65B 13/32 53/399
9,051,071 B2 6/2015 Perl et al.
10,053,247 B2 8/2018 Sato et al.
10,682,765 B2 * 6/2020 Mirkhaef ..... B25J 15/0433
11,161,634 B2 * 11/2021 Ribi ..... B65B 17/02
11,390,407 B2 * 7/2022 Ribi ..... B65B 27/04
2004/0232202 A1 * 11/2004 Mosca ..... B29C 65/08 156/580.2
2004/0250699 A1 * 12/2004 Kimmerle ..... B65B 13/04 100/27
2005/0167469 A1 * 8/2005 Schmetzer ..... B65B 13/32 228/44.3
2007/0181261 A1 * 8/2007 Schmetzer ..... B29C 66/1122 156/583.1
2008/0086987 A1 * 4/2008 Lucas ..... A01K 61/59 53/585
2008/0256900 A1 * 10/2008 Doyle ..... B65B 13/184 53/399
2010/0089005 A1 * 4/2010 Swift ..... B65B 27/10 53/399
2010/0308043 A1 * 12/2010 Wimmer ..... B65D 21/0204 53/531
2011/0056174 A1 * 3/2011 Perl ..... B65B 13/02 53/391
2011/0056810 A1 * 3/2011 Krause ..... B65G 17/08 198/842
2011/0061339 A1 * 3/2011 Hartness ..... B29C 66/83533 53/203
2011/0073511 A1 * 3/2011 Perl ..... B65D 71/50 53/399
2011/0147258 A1 * 6/2011 Hartness ..... B29C 63/423 493/186
2012/0098189 A1 * 4/2012 Meersoek ..... B65B 13/06 271/207
2012/0144777 A1 * 6/2012 Olsen ..... B65D 71/02 53/398
2012/0210674 A1 * 8/2012 Perl ..... B65B 27/04 53/589
2014/0034533 A1 * 2/2014 McWilliams ..... B65D 71/02 206/427
2014/0041534 A1 * 2/2014 Hartl ..... B65B 61/14 100/2
2014/0150383 A1 * 6/2014 Okamoto ..... B65B 13/12 53/589
2016/0221765 A1 * 8/2016 Joehren ..... B65G 47/846
2019/0023431 A1 * 1/2019 Elliott ..... B65B 57/00
2019/0217979 A1 * 7/2019 Ribi ..... B65D 71/50
2020/0216206 A1 * 7/2020 Ribi ..... B65B 35/44
2023/0057030 A1 * 2/2023 Lazzarin ..... F16L 1/24
2023/0249857 A1 * 8/2023 Ribi ..... B65B 65/003 53/48.1
2023/0358337 A1 * 11/2023 Lazzarin ..... F16L 1/20

FOREIGN PATENT DOCUMENTS

DE 102014213791 A1 * 1/2016 ..... B65B 13/04
DE 102014225880 A1 6/2016
EP 1886921 A1 * 2/2008 ..... B65B 17/025
WO WO-9967138 A1 * 12/1999 ..... B65B 61/14

OTHER PUBLICATIONS

PCT Application: PCT/EP2021/085612 filed Dec. 14, 2021—International Search Report dated Apr. 5, 2022.

* cited by examiner

STRAPPING DEVICE AND METHOD FOR PRODUCING STRAPPED PACKAGES

CLAIM OF PRIORITY

The present application claims priority to International Application PCT/EP2021/085612, dated Dec. 14, 2021, which in turn claims priority to German Application DE 10 2021 100 541.8, dated Jan. 13, 2021, which are incorporated by reference.

FIELD OF THE INVENTION

The present invention relates to a strapping device and to a method for producing strapped packages according to the features of the independent claims.

BACKGROUND OF THE INVENTION

Packages are an effective way of allowing simultaneous handling of several articles, for example in order to facilitate the transport of several articles at the same time. Packages comprised of several articles that are held together are therefore the most frequent sales unit variant for many articles such as beverage containers.

The articles can, for example, be objects, such as packaged or unpackaged items, cardboard boxes, containers such as beverage bottles or cans, or, on the other hand, packages made of multiple objects, wherein the objects of a package are, for example, themselves held together by an enclosure which surrounds the articles of the package on the periphery of the article group, for example in the form of a strap, an outer package, such as a wrapping, a heat shrink tube or a carton, a cardboard box or a carrying frame, to name just a few conceivable embodiments. An object or multiple objects held together with an enclosure can be packaged simultaneously using an enclosure. Thus, for example, beverage containers can not only be held together by shrink film wrappings, tapings or a carton to form packages, but can also be packaged at the same time.

In order to hold articles grouped into an article group together by a strap to form a package and thereby to secure the articles, the articles are first assembled according to a desired arrangement within a group of articles to be enclosed such as to form a package, and then a fastening belt—the so-called strapping belt—is placed around them during strapping. The strapping belt placed around the outer side of the article grouping is then tensioned by a strapping device, secured and cut.

The production of a strap with a strapping belt made of plastic, which strapping belt is placed around a group of articles by a fully automated strapping machine, tensioned, clamped and cut and then sealed by heating, is known, for example, from DE 10 2007 022 438 B3.

Strapping devices use so-called belt frames in which the strapping belt is guided around the group of articles to be strapped. A ring shape of the strapping belt is produced thereby.

A strapping head with a belt frame is described, for example, in DE 10 2014 225 880 A1.

What is disadvantageous is that inserting the strapping belt into the belt frame is prone to errors particularly with strapping materials that show low flexural stiffness. Also, friction of the strapping belts within the belt frame results in undesirable wear. Moreover, when using a belt frame for strapping, only relatively thin materials can be processed.

The object of the invention is to produce strapped packages in a cost-effective and simple manner.

The above object is achieved by a strapping device and a method for producing strapped packages which have the features of the respective independent claims. Further advantageous embodiments are described by the respective claims dependent thereon.

SUMMARY OF THE INVENTION

A strapping device according to the invention is used to for producing strapped packages in which at least two articles are combined by at least one strap, in particular by at least one strapping belt.

The strapping device is paired with a device for providing groups each comprising two or more articles. The device can preferably be an arrangement module or another suitable grouping device.

The articles are supplied to the arrangement module via a suitable transport device. Such a transport device can, in particular, be formed by a horizontal conveyor. A conveyor belt, a mat chain conveyor or a similar conveying device can be suitable as such horizontal conveyor. In this case, the articles are conveyed, for example, in an ordered or unordered mass flow In the arrangement module, at least two identical, in particular at least two identically formed articles are preferably assembled as an article group and subsequently combined by an outer package to give sales units, package units or strapped packages.

Optionally, at least two different articles can be assembled as an article group and subsequently combined. By assembling differently formed articles, so-called mixed packages can be produced, for example.

The articles can preferably be beverage containers, in particular bottles made of glass, PET or of another suitable material. However, the articles can also be a beverage containers in the form of cans made of plastic and/or metal sheet such as aluminum or the like.

However, the strapping device is also suitable for combining other suitable articles with a corresponding strap as package units or strapped packages.

The strap can be formed by a flexible strapping belt, for example a plastic belt, a paper belt or a belt made of a composite material. The strap can also be formed by a flat strapping blank which is provided in a stacking magazine standing or lying. In this case, the strap can be formed from a rather stiff material, for example a cardboard or the like.

The strapping belt or strapping blank is provided at least in one length, which length corresponds to at least one circumference of the article group. Preferably, the length of the strapping belt or the strapping blank is at least slightly longer than the circumference of the article group.

For strapping an article group, a strapping blank is removed from the stacking magazine or the like, for example, and transferred to the handling device described below. Alternatively, the strapping material may be provided as continuous material on a roll. In this case, corresponding sections of strapping material are each cut to length by the handling device described below before or in connection with fastening the strap to the article group.

Strapping of the article group is carried out by a handling device having two pivoting arms which can be adjusted relative to each other and each of which is equipped with clamping devices for fixing the belt ends of a strapping belt in a clamped manner. In order to strap the article group with a strapping belt fixed between the clamping devices of the pivoting arms, the pivoting arms of the handling device are pivoted such as to embrace the grouped articles. In particular, both the first and the second pivoting arm of the handling device are pivoted relative to one another.

In this case, it can be provided for the two pivoting arms to be pivoted toward one another synchronously and in the same manner. However, it can also be provided for the pivoting arms to be pivoted one after the other. In addition, the movement sequence of the pivoting movement carried out by the respective pivoting arm can be substantially the same or significantly different.

The pivoting movement is produced, for example, by a simple rotation or via a joint having multiple members.

One embodiment may provide for the two pivoting arms to be arranged pivotably on a base element. The two pivoting arms are pivoted in particular about at least one axis of rotation.

According to one embodiment, it is provided for the two pivoting arms to be pivotably articulated on a common axis of rotation. Another particularly preferred embodiment provides for the two pivoting arms to be each pivotably articulated about a separate axis of rotation, the axes of rotation preferably being oriented parallel to one another.

In principle, however, it is also possible to arrange the pivoting arms in a movable manner about axes that are skew or inclined relative to one another. In addition, the pivoting arms could basically also be formed by multi-axis robot arms.

Clamping devices for temporarily fixing the two free belt ends of the strapping belt in a clamped manner are provided on each free end area of the two pivoting arms.

The handling device can, in particular, assume an open state and a closed state. In the open state, clamping devices of the two pivoting arms are arranged at a maximum distance from one another. In particular, the distance between the clamping devices of the handling device in the open state corresponds substantially to the length of the strapping belt or strapping blank. The handling device is brought from the open state to the closed state by a pivoting movement of the two pivoting arms, in which the first pivoting arm performs a movement in the direction of the second pivoting arm and the second pivoting arm performs a movement in the direction of the first pivoting arm.

In this case, the group of articles arranged within the handling device is embraced or enclosed by the pivoting arms and thus by the strapping belt or strapping blank fixed within the handling device.

The two free belt ends of the strapping belt are thereby brought closer to one another and preferably arranged in a partially overlapping or at least abutting manner and connected to one another. For example, it is provided for the two pivoting arms to fold in order to produce the overlapping arrangement of the belt ends. During the pivoting movement of the pivoting arms, the clamping devices, which fix the strapping blank, perform a movement relative to the pivoting arms.

At the same time, due to the torque of the pivoting arm drive, the required pretensioning force of the strapping belt can be applied, for example a pretensioning force of about 160 N. A force control of the drive for the pivoting arms can be used for this.

According to one embodiment, it can be provided that in the closed state of the handling device, the pivoting arms be temporarily connected to one another in the overlap area and that the pretensioning force be generated by an additional pneumatic or electric drive in order to reduce the torques due to the long lever arms.

To connect the belt ends, the strapping device comprises a fixing device which is arranged on the handling device or is paired with the handling device. For example, it may be provided that the components for connecting the belt ends be formed by a separate component which is arranged stationarily adjacent to the handling device or which is arranged on a tool arm that is configured to be movable.

The manner of fixing or fastening the belt ends is dependent, inter alia, on the material of the strapping belt used. If the material is made of or contains at least some plastic, fastening can preferably take place by heat-sealing. In this case, the fixing device can be designed as a welding device with a punch and die. Furthermore, the fixing device can be designed as an ultrasonic unit (i.e., as an ultrasonic welding unit) with a sonotrode and an anvil tool in order to connect the belt ends to one another by ultrasonic welding, friction welding or ultra-friction welding.

However, such fixing devices can also be used well for strapping belts made of paper or strapping blanks made of a cardboard material and/or a composite material.

The fixing device can also be formed by a gluing device, an adhesive being applied to the belt ends to be connected in a targeted manner via a glue nozzle or the like.

A variant of the fixing device, which is particularly advantageous in practice, can optionally also provide for a clamping or crimping of the overlapping belt ends, which on the one hand ensures a permanent and mechanically robust connection, but on the other hand enables easy release of the belt ends. In the present context, crimping of the overlapping belt ends is to be understood to mean essentially the procedure explained below In the case of a crimp connection, each of the two belt ends is provided with at least one incision and/or at least one folding edge with an adjoining folded or bent section at the joint. These incisions and/or folding edges of the two belt ends are necessarily located one above the other at the joint in order to be able to engage one another. Since the folded or bent sections of the belt ends lying one above the other adjoin each other at least partially, the belt ends can be connected to one another in a form-fitting and adhesive manner at the joint.

In this case, the at least one folded section optionally projects from the surface of the belt end or can be bent by 180°, for example. The bent or folded sections form material tongues, wherein the incisions and sections lying one above the other form tongue pairs in each instance, which are lifted out of the belt plane, are bent and/or folded together, thus giving the desired stable connection of the two belt ends and thus a closed strapping belt.

The incisions into the belt ends can be designed to be, for example, straight, angled, triangular, T-shaped, U-shaped, semicircular, parabolic, rectangular, etc. Optionally, the incisions can also be designed in each instance in two parallel serrated rows lying closely together, for example U-shaped with serrated flanks and a straight end part. Due to the fact that the connections of the two belt ends are produced by bending the incision to form a bent edge on the non-incised part of the material tongues, a sufficiently stable fixing of the belt ends of the strapping belt can be produced. This is achieved by virtue of the fact that the two belt ends are connected to one another in an adhering and releasable manner at the joint, forming at least one form-fitting punching through both belt ends.

Unlike an adhesive or welded connection, this connection can be released relatively easily by a manually applied pull at the upper belt end, without the belt having to be cut through or handled in some other way. That is to say, the form-fitting connection produced by punching and folding material tongues can be undone without tools.

The tongue pairs are bent by an angle of at least 15° around their common bend, but in particular by an angle of at least 40°, particularly preferably by an angle of at least 60°.

After fixing the belt ends, as a result of which the strapping belt or strapping blank is closed, the pivoting arms of the handling device are released from the strapping belt or strapping blank by opening the clamping devices. The pivoting arms are again pivoted away from each other so that the strapped package produced in this way can be removed from the handling device and supplied to further processing. For example, a plurality of strapped packages are arranged on a pallet in a subsequent palletizing step in order to produce a transport or storage unit.

According to one embodiment, the entire handling device can execute a linear movement in the horizontal direction. Alternatively, it can be provided for the handling device to be moved synchronously with the group of articles. Furthermore, it can be provided that an already half-closed strapping belt or an already half-closed strapping blank be attached to the article group from above.

In particular, strapped packages according to the following method are produced using the strapping device described above:

- Providing two or more grouped articles,
- Providing a strapping belt of a length corresponding to at least one circumference of the grouped articles,
- Fixing a first belt end of the strapping belt on a first pivoting arm in a releasable or clamped manner, and fixing a second belt end of the strapping belt on a second pivoting arm in a releasable or clamped manner,
- Surrounding the grouped articles by pivoting the first pivoting arm and the second pivoting arm, wherein the fixed belt ends approach one another, whereby the strapping belt is placed around the grouped articles and is thereby tightened or pretensioned,
- Connecting the two belt ends of the strapping belt,
- Releasing the pivoting arms from the belt ends, and
- Removing the pivoting arms from the strapped package formed by fixing the strapping belt placed around the grouped articles and pretensioned.

In this case, a connection of the belt ends can be produced both on a longitudinal side and on a transverse side of an article group. When the belt ends are connected in the region of a longitudinal side, the pivoting arms can be designed to be shorter, as a result of which the torques are lower.

The strapping device described herein and the method for producing strapped packages are characterized by high performance and at the same time low susceptibility to errors. Various belt widths can be processed on strapping belts within the strapping device. Optionally, the pivoting arms and also the base element of the handling device of the strapping device can be designed to be variable in length so that the handling device can be easily changed in case of a product change in order to be able to process different belt lengths and/or different articles and/or article arrangements. In addition, materials with high stiffness and thickness can also be processed with the handling device, which materials cannot be provided as continuous material on a roll.

It should be expressly mentioned at this point that all aspects and embodiment variants which have been explained in connection with the strapping device according to the invention can also relate to, or be, partial aspects of the method according to the invention. Therefore, if the description or the claim definitions pertaining to the strapping device according to the invention make mention of certain aspects and/or correlations and/or effects, this applies equally to the method according to the invention. The same applies vice versa so that all aspects and embodiment variants which have been explained in connection with the method according to the invention can also relate to, or be, partial aspects of the strapping device according to the invention. Therefore, if the description or the claim definitions pertaining to the method according to the invention make mention of certain aspects and/or correlations and/or effects, this applies equally to the strapping device according to the invention.

BRIEF DESCRIPTION OF THE FIGURES

Exemplary embodiments of the invention and their advantages are explained in more detail below with reference to the accompanying figures. The proportions of the individual elements relative to one another in the figures do not always correspond to the actual proportions since some forms are simplified while other forms are shown enlarged in relation to other elements for better illustration.

DETAILED DESCRIPTION OF THE INVENTION

Figure 1:
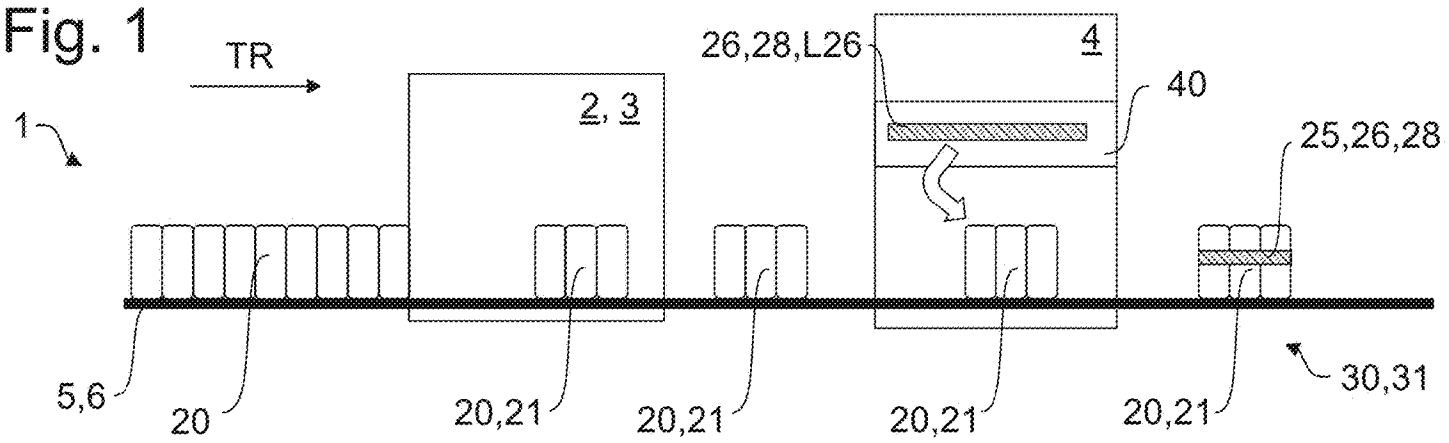
FIG. 1 schematically shows an embodiment of a packaging system for conveying, handling and packaging articles or article groupings.

Identical reference numerals are used for identical elements of the invention or those having the same effect. Furthermore, for the sake of clarity, only reference signs are shown in the individual figures, which are required for the description of the respective figure. The illustrated embodiments are merely examples of how the device according to the invention or the method according to the invention can be configured, and they are non-limiting.

The side view of FIG. 1 shows a schematic representation of a packaging system 1 and some of the assemblies pertaining to it. The packaging system 1 shown comprises a device 2 for providing two or more grouped articles 20, in particular an arrangement module 3.

The schematically indicated articles 20 can, for example or preferably, be beverage containers, in particular bottles made of glass, PET or of another suitable material. However, the articles 20 can also be a beverage containers in the form of cans made of plastic and/or metal sheet such as aluminum or the like.

However, the packaging system 1 is also suitable for combining other suitable articles 20 with a corresponding strap 25 as package units 30 or strapped packages 31.

Preferably, at least two identical, in particular at least two identically configured articles 20 are assembled as article group 21 in an arrangement module 3 or the like, and are combined by an outer package 25 to give sales units, package units 30 or strapped packages 31.

Optionally, at least two different articles 20 can be assembled as an article group 21 in the arrangement module 3 or the like, and can subsequently be combined by a strap 25 to give sales units or package units 30. By assembling differently formed articles 20 (not shown), so-called mixed packages can be produced, for example.

The articles 20 are supplied to the arrangement module 3 via a suitable transport device 5, for example a conveyor belt 6, in a transport direction TR. The articles 20 are supplied, for example, in an ordered or unordered mass flow.

Subsequently, the strap 25 is fastened to the articles 20 of the article group 21 in a strapping device 4, wherein a strapping belt 26 or a strapping blank 28 is tensioned around the articles 20 of the article group 21. For this purpose, the strapping device 4 comprises, in particular, a handling device 10 shown by way of example in FIGS. 2 to 4 and described in detail below The article group 21 strapped in this way forms a finished packaging unit 30 which is also referred to as strapped package 31. If necessary, the application of a further outer package, for example the fastening of an upper handle package or the like, can be provided simultaneously or subsequently or also beforehand.

The strapping belt 26 can be formed by a plastic belt. Alternatively, it is conceivable to use a paper belt, a pulp belt or a belt made of a composite material.

The strapping belt 26 is provided at least in a length L26, which length L26 corresponds to at least one circumference of the article group 21. It is preferably provided for the strap to be formed by a flat strapping blank 28 which is provided in a stacking magazine 40 standing or lying.

For strapping an article group 21, a strapping blank 28 is removed from the stacking magazine in each instance and transferred to the handling device 10 described below. The strapping blank 28 can be formed from a stiffer and/or thicker material, for example from a cardboard or the like.

Figure 2:
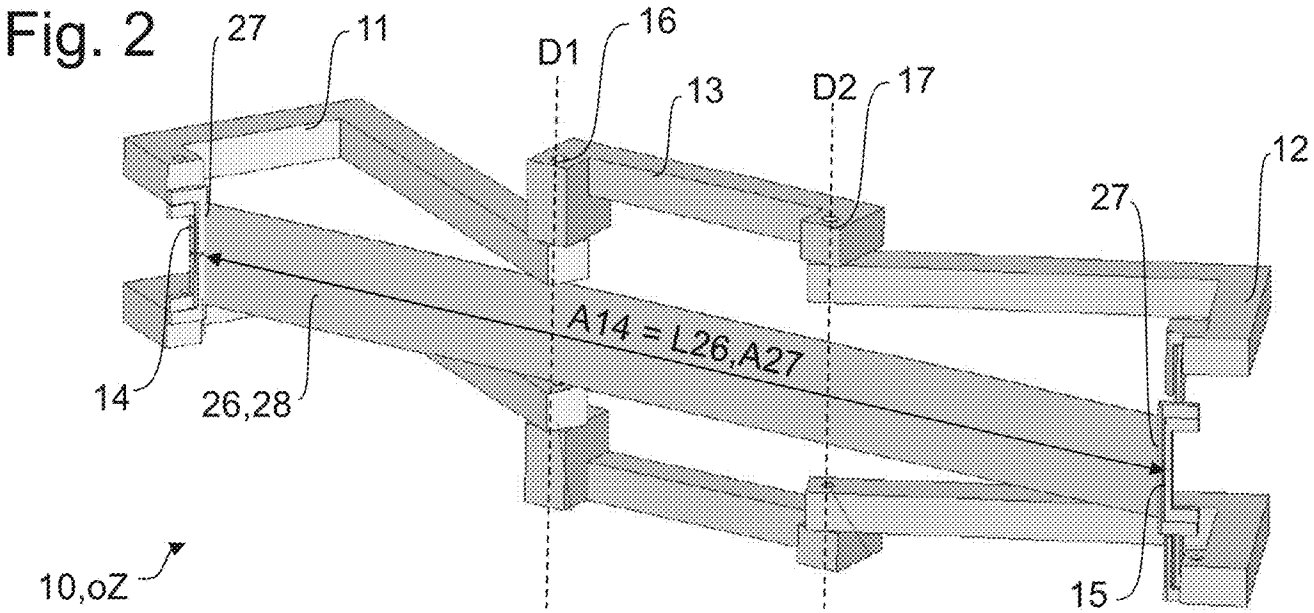
FIG. 2 shows a schematic perspective view of an embodiment variant of an open-state handling device for strapping articles, which handling device can be a component of the packaging system shown in FIG. 1.

The schematic perspective view of FIG. 2 shows a part of a handling device 10 for strapping articles 20 in an open state oZ.

Figure 3:
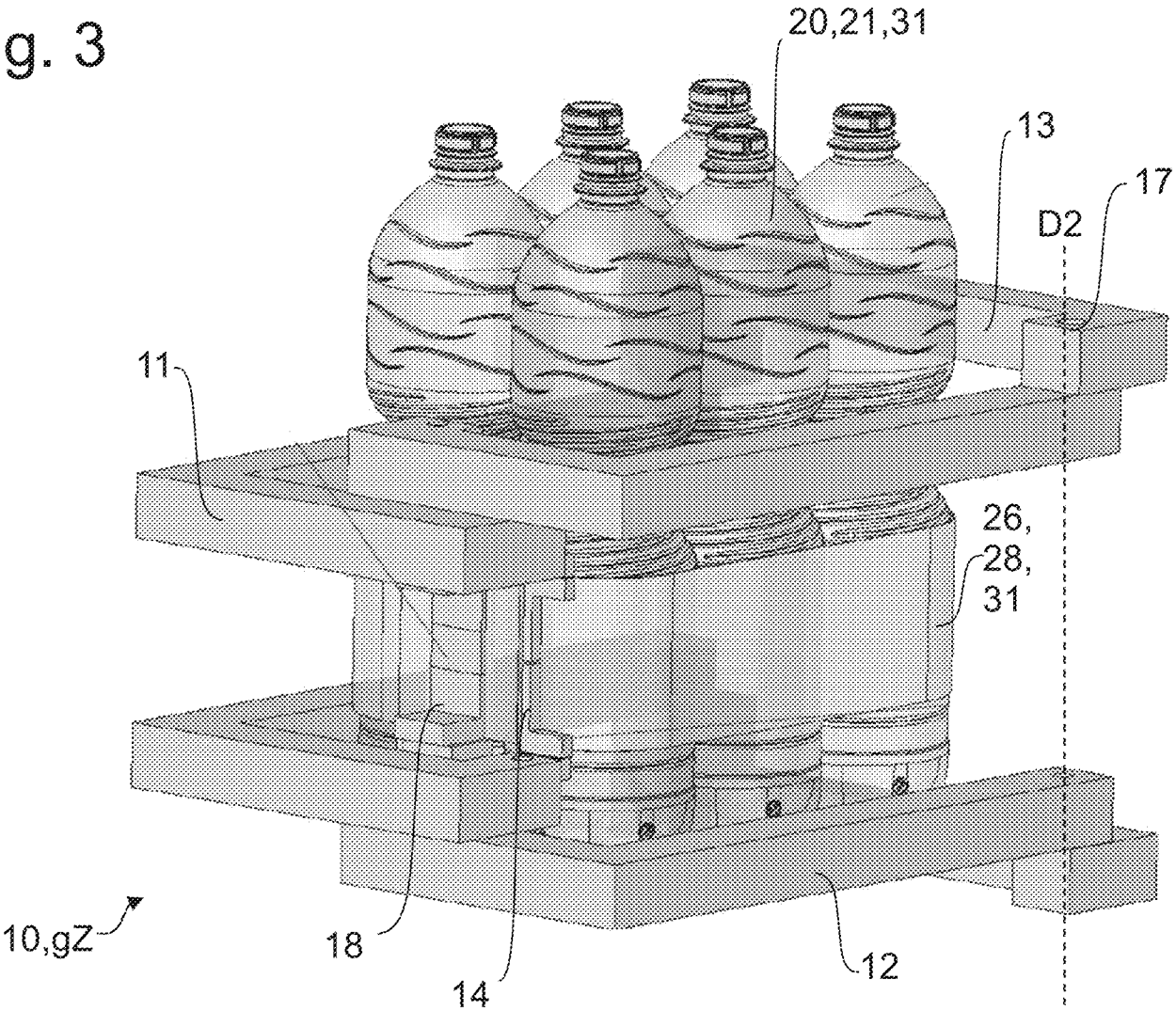
FIG. 3 shows the closed-state variant of the handling device shown in FIG. 2 for strapping articles.

The schematic perspective view of FIG. 3 shows the handling device 10 in a closed state gZ.

Figure 4:
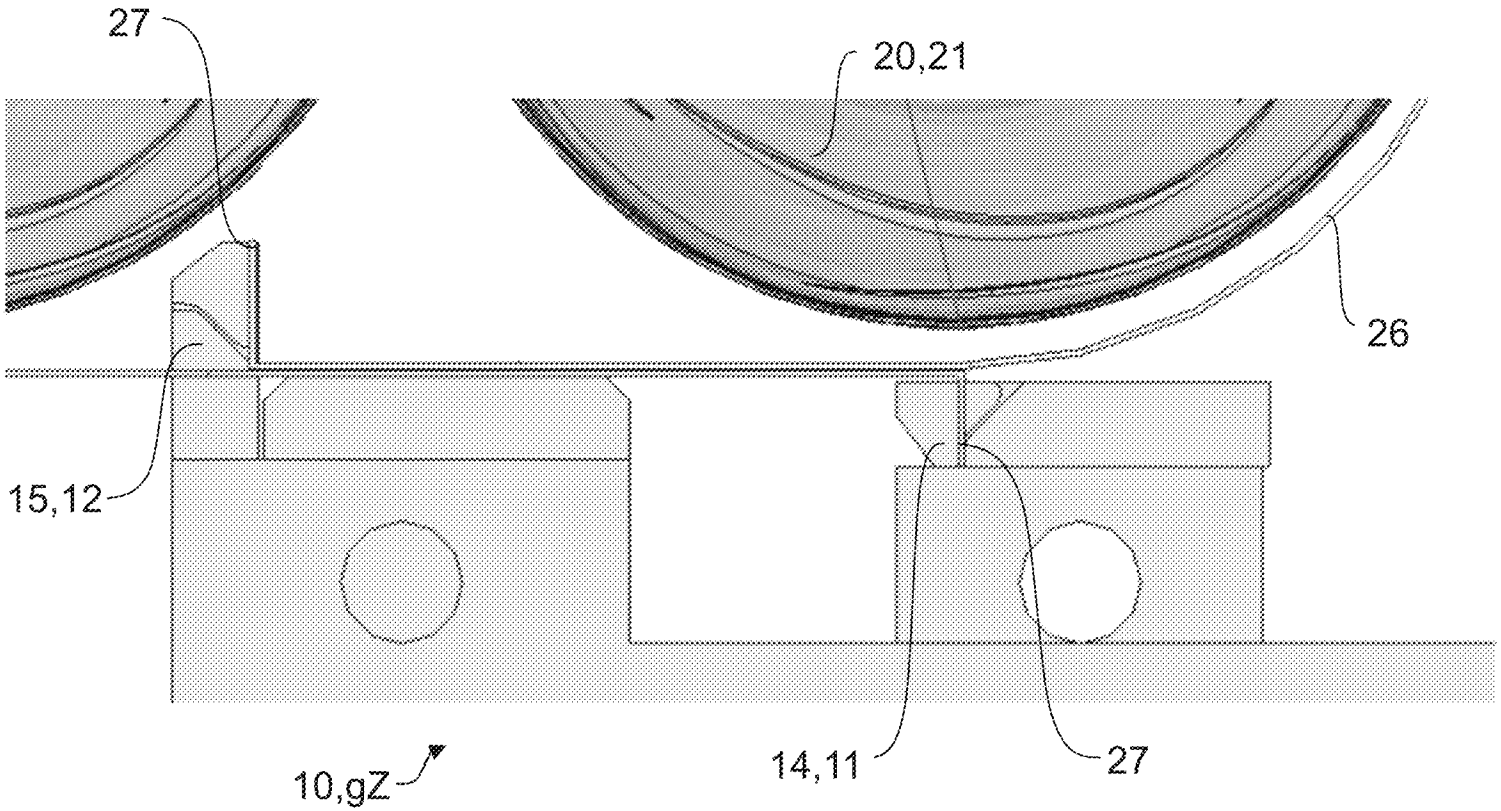
FIG. 4 shows details of the handling device as shown in FIGS. 2 and 3.

The schematic detail view of FIG. 4 shows further details of the handling device 10.

The handling device 10 has two pivoting arms 11, 12 which can be adjusted relative to each other and which are arranged pivotably on a base element 13, for example. In particular, a first pivoting arm 11 and a second pivoting arm 12 are arranged on the base element 13. Clamping devices 14,15 for fixing the two free belt ends 27 of a strapping belt 26 or a strapping blank 28 in a clamped manner are provided on each of the two pivoting arms 11, 12. Hereinafter, reference will be made only to the strapping belt 26, but this will also apply to the strapping blank 28.

In the open state oZ according to FIG. 2, the two pivoting arms 11, 12 are arranged to be pivoted away from each other such that the distance A14 between the clamping devices 14,15 of the two pivoting arms 11, 12 substantially corresponds to the length L26 of the strapping belt or the distance A27 between the free belt ends 27 of the strapping belt 26.

To form the strap 25, the pivoting arms 11 and 12 are pivoted around the article group 21 so that the article group 21 is enclosed or embraced by the handling device 10 in the closed state gZ according to FIG. 3.

The pivoting movement is produced, for example, by a simple rotation or via a joint having multiple members. The embodiment shown here provides for a pivoting of the two pivoting arms 11, 12 about two parallel axes of rotation D1 and D2. For this purpose, the first pivoting arm 11 is fastened, for example, in a first pivot point 16 to the base element 13 so as to be pivotable about a first axis of rotation D1, and the second pivoting arm 12 is fastened in a second pivot point 17 to the base element 13 so as to be pivotable about a second axis of rotation D2.

By pivoting the two pivoting arms 11, 12, the pretensioned strapping belt 26, which is held tightly between the clamping devices 14, 15, is placed around the article group 21. In this case, the strapping belt 26 is preferably tightened and/or tensioned around the outer lateral surfaces of the articles 20.

The two free belt ends 27 of the strapping belt 26 are thereby brought closer to one another and preferably arranged in a partially overlapping or at least abutting manner and connected to one another. For example, it is provided for the two pivoting arms 11, 12 to fold in order to produce the overlapping arrangement of the belt ends 27 (cf. FIG. 4).

During the pivoting movement of the pivoting arms 11, 12, the clamping devices 14, 15, which fix the strapping belt 26, perform a movement relative to the pivoting arms. At the same time, due to the torque of the pivoting arm drive (not shown), the required pretensioning force of the strapping belt 26 can be applied, for example a pretensioning force of about 160 N. A force control of the drive for the pivoting arms 11, 12 can be used for this. According to one embodiment, it can be provided that in the closed state gZ, the pivoting arms 11, 12 be temporarily connected to one another in the overlap area and that the pretensioning force be generated by an additional pneumatic or electric drive in order to reduce the torques due to the long lever arms.

A fixing device 18, for example, is provided for connecting the belt ends 27. The fixing device 18 can be designed, for example, as a welding device with a punch and die. The fixing device 18 could also be formed by a gluing device, an adhesive being applied to the belt ends 27 to be connected in a targeted manner via a glue nozzle or the like.

Furthermore, the fixing device 18 could be designed as an ultrasonic unit with a sonotrode and an anvil tool in order to connect the belt ends 27 to one another by ultrasonic welding or ultra-friction welding or, respectively, ultrasonic friction welding.

In addition, the fixing device 18 can have suitable means for producing crimp connections, which has already been explained in more detail above. In the present context, crimp connections are understood to mean the formation of corresponding incisions and fold edges which are introduced into the overlapping belt ends, after which each folded section optionally projects from the surface of the belt end or, for example, can also be folded. The bent or folded sections form material tongues, wherein the incisions and sections lying one above the other form tongue pairs in each instance, which are lifted out of the belt plane, are bent and/or folded together, thus giving the desired stable connection of the two belt ends and thus a closed strapping belt.

Alternatively, it can be provided for the components for connecting the belt ends 27 to be allocated separately to the handling device 10 and, for example, to be formed by a separate component which is arranged in a stationary manner or which is arranged on a tool arm that is configured to be movable.

Subsequently, the pivoting arms 11, 12 are disconnected from the strapping belt 26 by opening the clamping devices 14, 15, and the pivoting arms 11, 12 are again pivoted away from each other so that the strapped package 31 produced in this way can be removed from the handling device 10 and supplied to further processing.

The entire handling device 10 can, for example, execute a linear movement in the horizontal direction or can also be moved synchronously with the article group 21. It can also be provided that already half-closed strapping belts 26 be attached to the respective article group 21 from above.

As shown in FIGS. 2 to 4, this method can be used to produce a connection of the belt ends 27 both on a longitudinal side and on a transverse side of an article group 21. When the belt ends 27 are connected in the region of a longitudinal side, the pivoting arms 11, 12 can be designed to be shorter, as a result of which the torques are lower.

The handling device 10 described herein is characterized by high performance and at the same time low susceptibility to errors. Various belt widths can be processed within the device. Optionally, the pivoting arms 11, 12 and also the base element 13 can be designed to be variable in length, so that the handling device 10 can be easily changed so that different belt lengths L26 and/or different article groups 21 can be processed. In addition, materials with high stiffness and thickness can also be processed with the handling device 10, which materials cannot be provided as continuous material on a roll.

The embodiments, examples and variants of the preceding paragraphs, the claims or the following description and the figures, including their various views or respective individual features, may be used independently of one another or in any combination. Features described in connection with an embodiment are applicable for all embodiments provided the features are not incompatible.

If, in the context of the description of the description of the figures, reference is also generally made to "schematic" representations and views, this means by no means that the figure representations and their description are to be of subordinate importance with regard to the disclosure of the invention. The person skilled in the art is certainly able to derive sufficient information from the schematically and abstractly drawn representations that will make it easier for the person skilled in the art to understand the invention without being confused in any way by the drawn and possibly not exactly true-to-scale proportions of the articles and/or parts of the device or other drawn elements. The figures enable the person skilled in the art as reader to get a better understanding of the inventive idea, which has been formulated more generally and/or more abstractly in the claims and in the general part of the description, on the basis of the more specifically explained implementations of the method according to the invention and the more specifically explained mode of operation of the device according to the invention.

The invention has been described with reference to a preferred embodiment. However, it is conceivable for a person skilled in the art that modifications or changes can be made to the invention without departing from the scope of protection of the following claims.

LIST OF REFERENCE SIGNS

1 Packaging system
2 Device
3 Arrangement module
4 Strapping device
5 Transport device
6 Conveyor belt
10 Handling device
11 (First) pivoting arm
12 (Second) pivoting arm
13 Base element
14 (First) clamping device
15 (Second) clamping device
16 (First) pivot point
17 (Second) pivot point
18 Fixing device
20 Article
21 Article group
25 Strap
26 Strapping belt
27 Free belt end
28 Strapping blank
30 Package unit
31 Strapped package
40 Stacking magazine
A14 Distance between clamping devices
A27 Distance between free belt ends
D1 (First) axis of rotation
D2 (Second) axis of rotation
gZ Closed state
L26 Strapping belt length
oZ Open/opened state
TR Transport direction

The invention claimed is:

1. A device for producing finished packaging units (30) formed from at least two articles (20) combined by at least one strap, comprising:

a strapping device (4), comprising:

a handling device (10) with two pivoting arms (11, 12), which can be adjusted relative to each other, and wherein each of the two pivoting arms (11, 12) is equipped with clamping devices (14, 15) for fixing two belt ends (27) of a strapping belt (26) or a strapping blank (28) in a clamped manner, wherein a distance between the clamping devices (14, 15) in an open state of the two pivoting arms (11, 12) corresponds substantially to a length of the strapping belt (26) or strapping blank (27) clamped by the clamping devices (14, 15), wherein the two pivoting arms (11, 12) pivot and fold to produce an overlapping arrangement of the two belt ends (27) when the two pivoting arms (11, 12) are in a closed state, and to be temporarily connected to one another in the closed state to facilitate pre-tensioning of the strapping belt (26) or the strapping blank (28), and wherein, during pivoting by the two pivoting arms (11, 12), the clamping devices (14,15) move relative to the two pivoting arms, and a fixing device (18) for connecting the two belt ends (27) of the strapping belt (26) or the strapping blank (28) to form a finished packaging unit (30).

2. The device of claim 1, wherein the two pivoting arms (11, 12) of the strapping device (4) are pivotably arranged about at least one axis of rotation.

3. The device of claim 2, wherein the two pivoting arms (11, 12) of the strapping device (4) are each pivotable about a separate axis of rotation (D1, D2).

4. The device of claim 3, wherein the two pivoting arms (11, 12) of the strapping device (4) are arranged on a base element (13) of the handling device (10).

5. The device of claim 3, wherein the two pivoting arms (11, 12) of the strapping device (4) are formed by multi-axis robot arms.

6. The device of claim 1, wherein the fixing device (18) of the strapping device (4) is arranged on the handling device (10) or is paired with the handling device (10).

7. The device of claim 6, wherein the fixing device (18) of the strapping device (4) comprises a welding unit or an ultrasonic welding unit.

8. The device of claim 6, wherein the fixing device (18) of the strapping device (4) comprises a gluing unit.

9. The device of claim 6, wherein the fixing device (18) of the strapping device (4) comprises a device for introducing corresponding incisions or folding edges, located one above the other, into each of the two belt ends (27) with adjoining folded or bent sections, wherein the folded or bent sections of the belt ends (27) lying one above the other adjoin each other at least partially and connect the belt ends (27) to one another in a form-fitting and welded manner at the joint (26).

* * * * *